US006472971B2

(12) United States Patent
Toyama et al.

(10) Patent No.: US 6,472,971 B2
(45) Date of Patent: Oct. 29, 2002

(54) CIRCUIT BREAKER

(75) Inventors: Kentaro Toyama, Kanagawa (JP); Naoshi Uchida, Saitama (JP); Koji Asakawa, Saitama (JP); Isamu Ohshima, Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 122 days.

(21) Appl. No.: 09/785,561

(22) Filed: Feb. 20, 2001

(65) Prior Publication Data

US 2001/0024154 A1 Sep. 27, 2001

(30) Foreign Application Priority Data

Mar. 6, 2000 (JP) ..... 2000-060755

(51) Int. Cl.[7] ..... H01H 71/16; H01H 71/64; H01H 77/00; H01H 3/04; H01H 23/02

(52) U.S. Cl. ..... 337/59; 337/12; 337/13; 337/55; 337/56; 361/102; 361/115; 335/35; 335/173; 335/191; 200/401

(58) Field of Search ..... 337/12, 13, 16, 337/36, 55, 56, 59, 60, 70–74, 345, 346, 350, 358; 361/31, 32, 102, 115; 335/35, 172, 173, 188–191, 192; 200/401, 329, 339

(56) References Cited

U.S. PATENT DOCUMENTS 3,599,130 A * 8/1971 Murai et al. ..... 335/174
3,805,199 A * 4/1974 Tazuki ..... 200/401
3,810,051 A * 5/1974 Walker et al. ..... 335/167
4,144,427 A * 3/1979 Gryctko et al. ..... 200/288
4,146,855 A * 3/1979 Schultz et al. ..... 335/16
4,894,747 A * 1/1990 Livesey et al. ..... 335/16
5,008,504 A * 4/1991 Ozaki et al. ..... 200/322
5,260,533 A * 11/1993 Livesey et al. ..... 200/288
5,901,025 A * 5/1999 Takahashi et al. ..... 361/115
5,990,434 A * 11/1999 Fujihira et al. ..... 200/401

FOREIGN PATENT DOCUMENTS

JP 9-282995 * 10/1997 ..... H01H/71/12
JP 11-86714 3/1999

* cited by examiner

*Primary Examiner*—Anatoly Vortman
(74) *Attorney, Agent, or Firm*—Kanesaka & Takeuchi

(57) ABSTRACT

A circuit breaker includes main circuit contact shoes disposed in a circuit breaker case and urged by a contact spring, a contact opening and closing mechanism located above the contact shoes and including an opening and closing lever, a toggle link, an opening and closing handle and a latch, and an overcurrent tripping device located above the contact shoes. The toggle link includes a first link extending between the opening and closing lever and a toggle shaft located above, and a second link extending between the toggle shaft and the latch to overlap the first link in the V-form, and an opening and closing spring extends between the toggle shaft and a tip of a handle lever coupled to the opening and closing handle to extend downward. As a result, a space occupied by the contact opening and closing mechanism section in the height direction can be reduced to make the circuit breaker more compact.

7 Claims, 4 Drawing Sheets

CIRCUIT BREAKER

BACKGROUND OF THE INVENTION AND RELATED ART STATEMENT

The present invention relates to a circuit breaker, such as a molded case circuit breaker for actuating and stopping an electric motor and protecting it from overcurrent, and more specifically, to an assembly structure of a contact opening and closing mechanism therefor.

An assembly structure such as that shown in FIG. 4 is known as the circuit breaker referred to above. In FIG. 4, reference numeral 1 denotes a circuit breaker case as a resin molded article comprising a lower case 1*a* and an upper cover 1*b*, 2 is a power-side main circuit terminal corresponding to each pole, and 3 is a load-side main circuit terminal. The lower case 1*a* has a main circuit contact section integrated thereinto and comprising an assembly of fixed contact shoes 4 and 5 connected to the corresponding main circuit terminals, a movable contact shoe 6 bridging the fixed contact shoes 4 and 5, a contact spring 7, a contact shoe holder 8, and arc extinguishing plates 9.

In addition, the upper cover 1*b* includes an opening and closing lever 10 made of an insulating material and having a journaled rear end and a tip facing a top surface of the contact shoe holder 8, an opening and closing handle 11 projecting from a top surface of the upper cover 1*b*, a contact opening and closing mechanism section 12 linking between the opening and closing handle 11 and the opening and closing lever 10, an overcurrent tripping device 13 including a thermal tripping device 13*a* operating in response to a load current through the main circuit and an electromagnetic tripping device 13*b* operating instantaneously in response to a short circuit current, and others. All these components are integrated into the upper cover 1*b*.

In this case, the contact opening and closing mechanism section 12 of the conventional circuit breaker comprises an assembly of a toggle link that couples two links together in the form of "V" in such a manner as to sandwich a toggle shaft in a vertical direction of the circuit breaker, to link between the opening and closing handle 11 and the opening and closing lever 10, an opening and closing spring or a main spring extending between the toggle link and a lever of the opening and closing handle 11, and a latch with which the overcurrent tripping device 13 is linked via a trip cross bar (not shown).

The opening and closing operations of such a circuit breaker are well known. When the opening and closing handle 11 is manually operated to the ON side, accumulated force from the opening and closing spring lifts the opening and closing lever 10. This causes the movable contact shoe 6, urged by the contact spring 7, to rise with the holder 8 to bridge the fixed contact shoes 4 and 5. In this contact-closed state, a main circuit current flows from the main circuit terminal 2 through the fixed contact shoe 4, the movable contact shoe 6, the fixed contact shoe 5, and the overcurrent tripping device 13 to the main circuit terminal 3.

Additionally, when the opening and closing handle 11 is operated to the OFF position, the accumulated force of the opening and closing spring of the contact opening and closing mechanism section 12 moves the toggle link reversely to drive the opening and closing lever 10 clockwise from a receding position to push the movable contact shoe 6 downward against the force of the contact spring 7 together with the holder 8, thereby separating the movable contact shoe 6 from the fixed contact shoes 4 and 5 to open the main circuit contact. On the other hand, when an overcurrent or a short-circuit current flows through the main circuit in a conductive state, the overcurrent tripping device 13 operates to release the latch of the contact opening and closing mechanism section 12 to drive the opening and closing lever 10 counterclockwise by the accumulated force of the opening and closing spring. Thus, the movable contact shoe 6 is opened to shut off the main circuit current, i.e. tripping operation.

The above-described conventional circuit breaker structure has problems in regard to the external dimensions of the entire circuit breaker, manual opening and closing operations, and a circuit opening operation.

(1) In the structure shown in FIG. 4, which incorporates the bridging contact-shoe type main circuit contact section located at the bottom of the case 1, and the opening and closing lever 10, the opening and closing handle 11, the contact opening and closing mechanism section 12 and other components located above the main circuit contact section, the entire circuit breaker has a large height H. In particular, if the toggle link of the contact opening and closing mechanism section 12 comprises two links coupled together in the form of a "V" in the vertical direction of the circuit breaker, the toggle link has a large height in an extended state, and moves over a wide range when each link, which has been extended, is bent and moved reversely. Consequently, it is difficult to design a small and compact circuit breaker.

(2) Additionally, in the conventional circuit breaker, when the main circuit contact shoe is closed as shown in FIG. 4, a tip of the opening and closing lever 10 abuts against a top surface of the contact shoe holder 8. When the contact shoes are then opened, an opening and closing spring force from the contact opening and closing mechanism section 12 is applied to the opening and closing lever 10 as a static pressure to push the top surface of the contact shoe holder 8 downward, which has been pressed upward by the contact spring 7, thereby opening the movable contact shoe 6. Thus, if the contacts of the fixed and movable contact shoes have been welded or fixed together due to conduction of a high current, an error in the shutting-off operation may occur. For example, the movable contact shoe may not open or its opening may be delayed. To prevent such error, it is contemplated that the opening and closing spring integrated into the contact opening and closing mechanism section 12 may be enhanced. A stronger force of the opening and closing spring, however, results in the necessity of a stronger force for manually operating the opening and closing handle 11, thereby preventing a user from operating the circuit breaker easily.

The present invention has been made in view of the above points, and it is an object of the invention to solve the above-described problems and to provide a circuit breaker with an improved contact opening and closing mechanism that serves to reduce the size of the circuit breaker, to simplify circuit-opening operations and to facilitate operations.

Other objects and advantages of the invention will be apparent from the following description of the invention.

SUMMARY OF THE INVENTION

In order to attain the above object, the present invention provides a circuit breaker comprising a main circuit contact section disposed in a case at a bottom thereof and including an assembly of a fixed contact shoe, a movable contact shoe held in a contact shoe holder, and a contact spring that presses and urges the movable contact shoe toward the fixed contact shoe; a movable opening and closing lever located above the main circuit contact section and having a journaled rear end and a tip located at a portion facing a top surface of the holder; a contact opening and closing mechanism also located above the main circuit contact section and including a combination of a toggle link linked with the opening and closing lever, an opening and closing handle, an opening and closing spring extending between a handle lever for the opening and closing handle and the toggle link, and a latch linked with the toggle link; and an overcurrent tripping device located above the main circuit contact section to detect an overcurrent through a main circuit to release the latch.

In the first aspect of the invention, the toggle link comprises a first link having a lower end coupled to the opening and closing lever to extend to a toggle shaft located above, and a second link extending between the toggle shaft and the latch in such a manner as to overlap the first link in a V-form, with the opening and closing spring extending between the toggle shaft and a tip of the handle lever coupled to the opening and closing handle to extend downward.

As compared with the conventional structure wherein the two vertically-arranged links are coupled together in the V-form and extended or bent to operate the opening and closing lever in an opening or closing direction by pivoting, the above configuration serves to reduce the space occupied by the contact opening and closing mechanism section in the height direction of the circuit breaker, making the entire circuit breaker more compact.

Additionally, according to the second aspect of the present invention, the circuit breaker according to the first aspect is set so that when the movable contact shoe is closed, a gap is formed between the top surface of the movable holder of the main circuit contact section and the tip of the opposite opening and closing lever. Accordingly, when the circuit breaker is opened, the tip of the opening and closing lever, pivoted due the force of the opening and closing spring, comes to abut against the top surface of the contact shoe holder of the main circuit contact section to apply a dynamic impact force thereto to open the movable contact shoe.

Thus, if the same spring force of the opening and closing spring is assumed to be applied to the opening and closing lever, a force that pushes the contact shoe holder to open the movable contact shoe is much stronger when it takes the form of a dynamic impact force rather than a static pressure. Consequently, even if the contacts of the fixed and movable contact shoes are fixed or welded together, the movable contact shoe can be reliably separated from the fixed contact shoe to ensure more reliable operation.

Further, according to the third aspect of the present invention, the circuit breaker according to the first aspect has a supplementary spring that helps the opening and closing spring and presses the opening and closing lever toward the contact shoe holder when the main circuit contact is opened.

With such a configuration, the supplementary spring acts on the top surface of the opening and closing lever as a push-in force to offset the force of the contact spring pressing and urging the movable contact shoe from below. Accordingly, the movable contact shoe can be driven from a closed position to an open position, effectively by using the accumulated force of the opening and closing spring as a main spring without requiring of a strong force to operate the opening and closing handle, thereby facilitating the operations required to open the circuit breaker. Additionally, when the circuit breaker is closed, if the opening and closing lever stands by in such a manner that its tip is spaced from the contact shoe holder as explained before, the force from the supplementary spring is prevented from interfering with the contact spring of the movable contact shoe, thereby providing the sufficient contact pressure between the fixed contact shoe and the movable contact shoe.

In the fourth aspect of the invention, the supplementary spring in the third aspect has one end coupled to a supplementary push-in lever that slides over a cam surface formed at a top surface of the opening and closing lever to drive the supplementary lever to apply a push-in force to the opening and closing lever when the main circuit contact is opened.

With such a configuration, when the circuit breaker is opened, the force of the supplementary spring acts on the top surface of the opening and closing lever via the supplementary lever as a push-in force to offset the force of the contact spring for pressing and driving the movable contact shoe from below. Accordingly, the movable contact shoe can be driven from the closed position to the open position by effectively using the accumulated force of the opening and closing spring as a main spring without requiring a strong force to operate the opening and closing handle, thereby facilitating operations required to open the circuit breaker.

BRIEF DESCRIPTION OF THE DRAWINGS

FIG. 1(*b*) is a perspective view of a main mechanism in FIG. 1(*a*);

FIG. 2(*b*) is an enlarged side view showing a part of the circuit breaker in a closed state;

FIG. 3(*b*) is an enlarged side view showing a part of the circuit breaker in the closed state.

DETAILED DESCRIPTION OF PREFERRED EMBODIMENTS

Figure 1A:
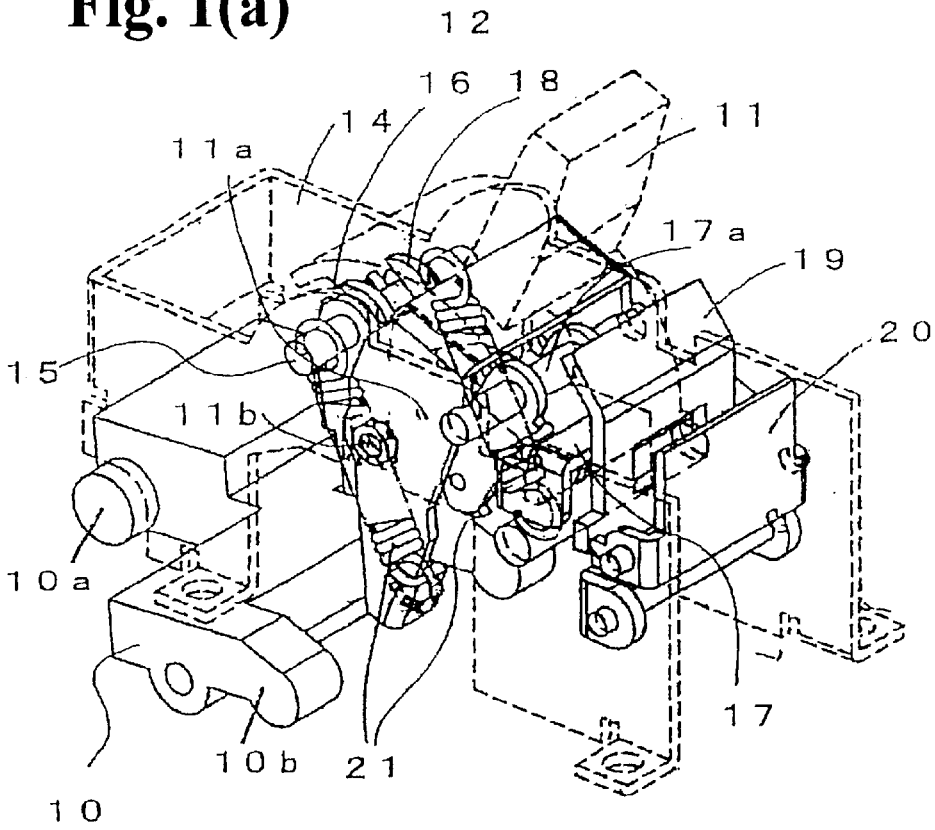
FIG. 1(*a*) is a perspective view of an assembled state of a contact opening and closing mechanism section of a circuit breaker corresponding to a first embodiment of the present invention.

The present invention will be described below based on illustrated embodiments. In the drawings, numerals corresponding to FIG. 4 are used for the same or similar parts, and a detailed description thereof is omitted.

Figure 1B:
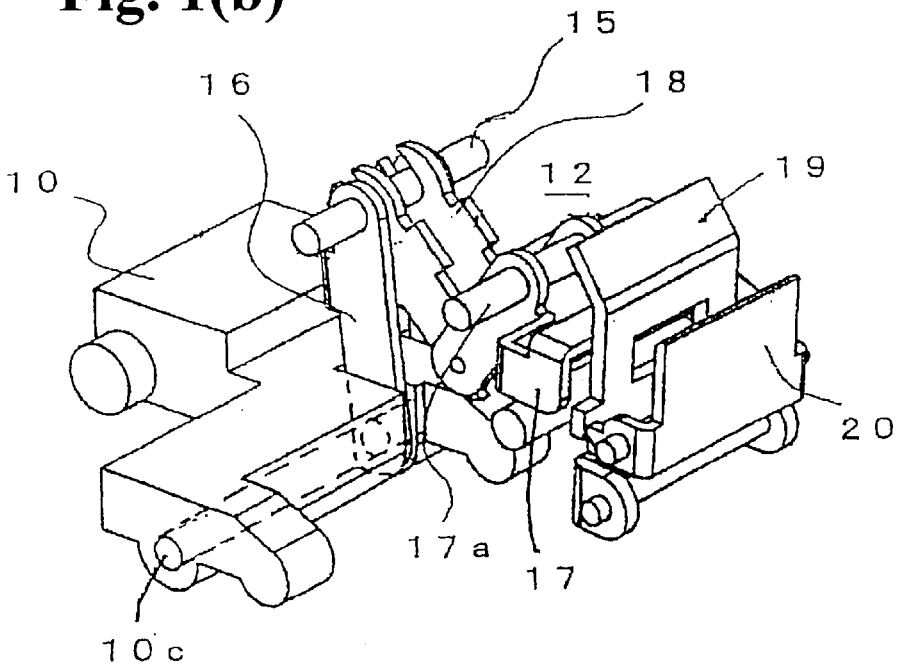
Figure 2A:
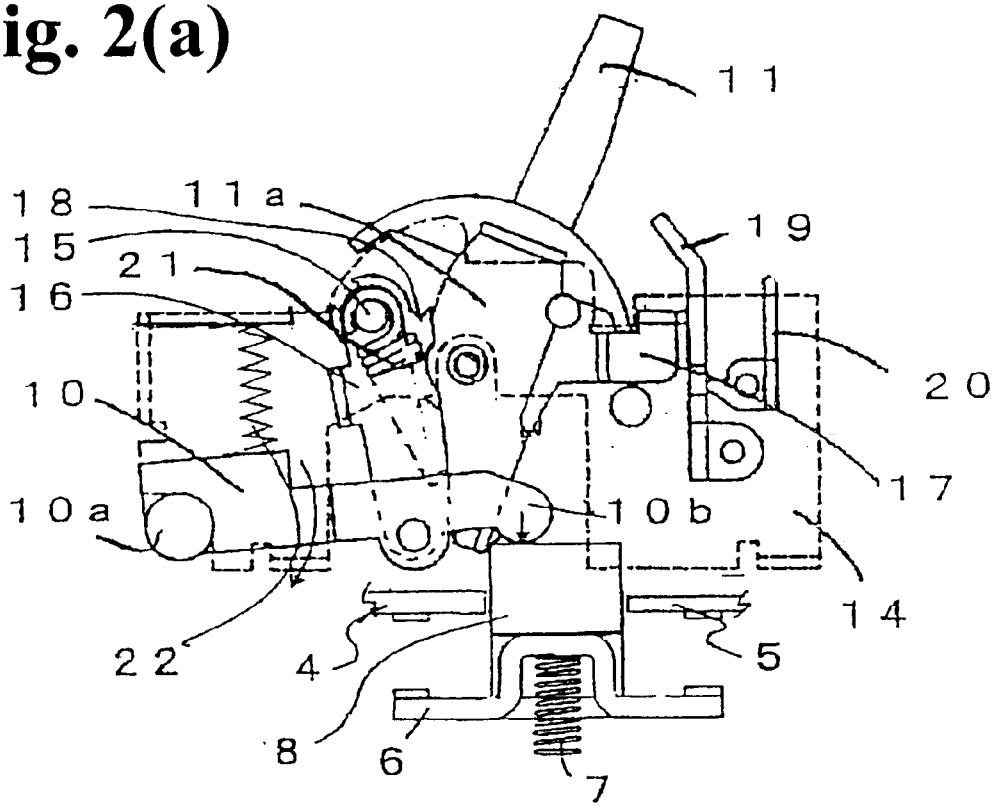
FIG. 2(*a*) is a side view of the circuit breaker at an open state with the contact opening and closing mechanism section combined with a main circuit contact section.
Figure 2B:
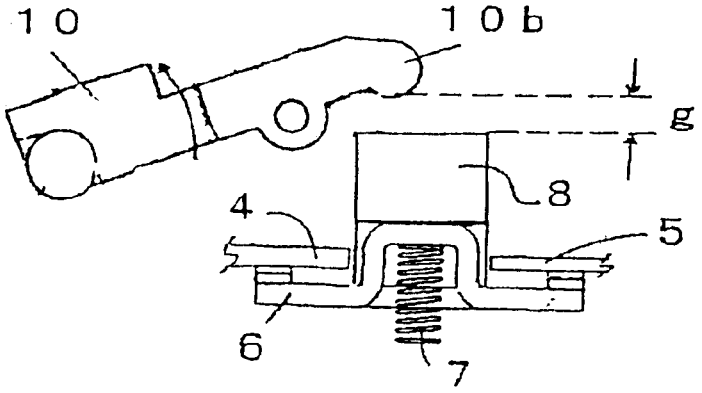
Figure 4:
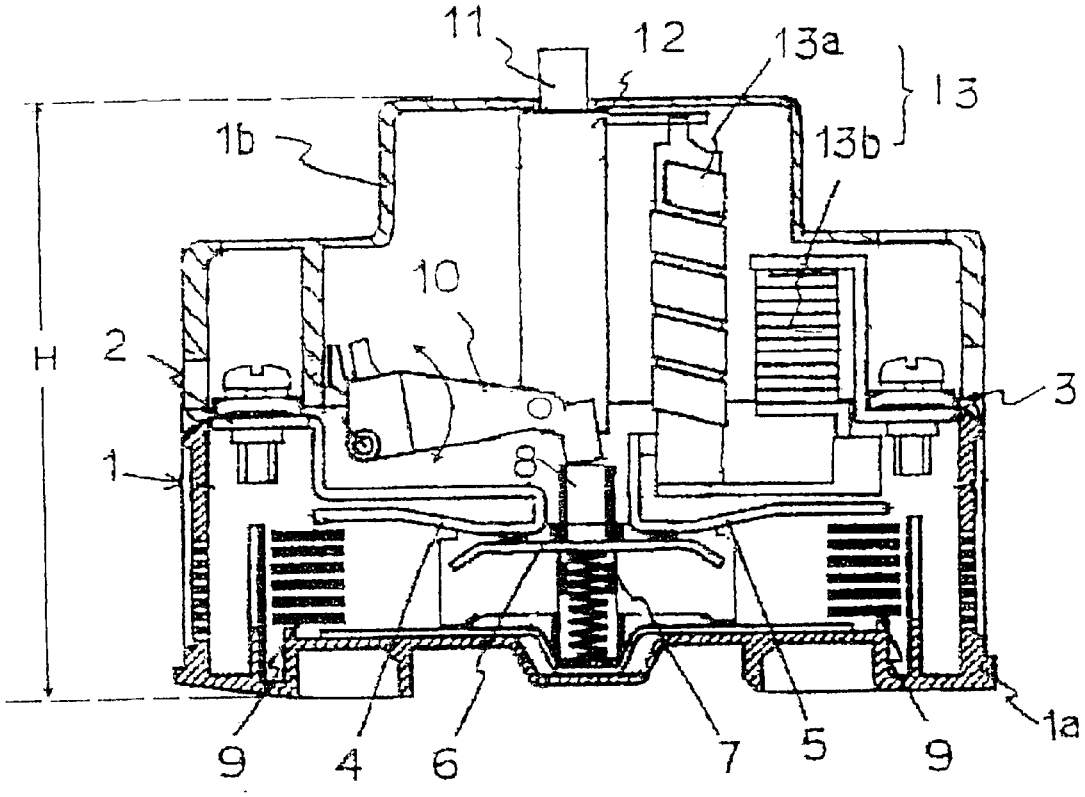
Fig. 4 Prior Art
FIG. 4 is a sectional view showing a configuration of a conventional circuit breaker to which the invention is directed.

FIGS. 1(*a*) and (*b*) show the structure of a main part of a contact opening and closing mechanism section according to a first embodiment of the present invention which is applied to the contact opening and closing mechanism section of the circuit breaker shown in FIG. 4. In these figures, an opening and closing lever 10 is made of an insulating material and is journaled and fixed to an assembly frame 14 via a shaft section 10*a* located at a rear end, and a forked tip portion 10*b* is located at a position facing a top surface of a contact shoe holder 8 of a main circuit contact section as shown in FIGS. 2(*a*) and 2(*b*).

Additionally, a contact opening and closing mechanism section 12 includes a toggle link comprising a first link 16 extending between a shaft 10*c* provided in the opening and closing lever 10 and a toggle shaft 15 located above, and a second link 18 extending between the toggle shaft 15 and a latch 17 in such a manner as to overlap the first link 16 in the form of "V". For the toggle link, an opening and closing spring or a main spring 21 extends between a tip of a handle lever 11*a* and the toggle shaft 15, the handle lever 11*a* extending downward from the opening and closing handle 11. The handle lever 11 is journaled to an assembly frame 14 via a support shaft 11*b*.

In addition, in the assembly structure, a latch 17 is supported in the frame 14 via a support shaft 17*a*, and a latch claw section is locked and supported on a swingable latch receiver 19. Also, a support member 20 for the latch receiver 19 is located opposite to a trip cross bar (not shown).

Next, the operation of the contact opening and closing mechanism configured as described above will be explained. FIG. 1(*a*) shows an open state of the main circuit contact where the tip portion 10*b* of the opening and closing lever 10 pushes the contact shoe holder 8 of the main circuit contact section downward to separate the movable contact shoe 6 from the fixed contact shoes 4 and 5 as shown in FIG. 2(*a*). Then, when the opening and closing handle 11 is brought down to the ON position, the handle lever 11*a* rotates around the support shaft 11*b* in a counterclockwise direction. When the connection between the handle lever 11*a* and the opening and closing spring 21 correspondingly passes beyond an axis joining the toggle shaft 15 with the lever support shaft 11*b*, the accumulated force of the opening and closing spring 21 moves the toggle link reversely to rotate the second link 18 clockwise, using a connection between the second link 18 and the latch 17 as a support point, thereby pulling the first link 16 rightward together with the toggle shaft 15. This causes the opening and closing lever 10 to rotate counterclockwise around the support shaft 10*a* and move upward as shown in FIG. 2(*b*). As a result, the movable contact shoe 6 is urged and closed by the contact spring 7.

On the other hand, when the opening and closing handle 11, which is closed, is rotated clockwise, the toggle link moves in a direction opposite to that described above to rotate the opening and closing lever 10 clockwise to push the contact shoe holder 8 against the force of the contact spring 7 downward, thereby opening the movable contact shoe 6.

As is apparent from the above description of the operation, the toggle link moves in such a manner that the first link 16 and the second link 18 overlap each other in the V-form by using the toggle shaft 15 as a support point. Thus, as compared to the conventional toggle link with the two links coupled together in the V-form in a vertical direction of the circuit breaker, a motion range in a height direction of the circuit breaker decreases to half to make the contact opening and closing mechanism smaller and more compact.

In addition, in the contact opening and closing mechanism in the illustrated embodiment, the toggle link mechanism is set so that when the contact shoes are closed, a gap g is formed between the tip portion 10*b* of the opening and closing lever 10 and a top surface of the contact shoe holder 8 as shown in FIG. 2(*b*). A supplementary spring or a compression spring 22 is additionally installed on the opening and closing lever 10 to apply a spring force in a direction in which the lever is pushed downward as shown in FIG. 2(*a*).

If the gap g remains between the tip portion 10*b* of the opening and closing lever 10 and the contact shoe holder 8 when the contact shoes are closed, as described above, when the contact shoes are opened by means of the operation of the opening and closing handle 11 or a trip operation by an overcurrent tripping device, the tip portion 10*b* of the opening and closing lever 10, which moves reversely from its receding position due to the accumulated force of the opening and closing spring 21, moves through the gap g and then comes to abut against the top surface of the contact shoe holder 8, thereby applying a dynamic impact opening force thereto. Consequently, even if current flowing through a main circuit in the closed state causes the fixed contact shoes 4 and 5 and the movable contact shoe 6 to be welded or fixed together, thereby preventing the contact shoes from being opened, the dynamic impact opening force applied to the contact shoe holder 8 allows the main circuit contact shoes to be reliably opened, thereby enabling the circuit breaker to operate more reliably.

Further, when the contact spring 7 is used to provide a strong force in order to increase a contact pressure between the fixed contact shoes and the movable contact shoe when they are closed, the force of the opening and closing spring 21 of the contact opening and closing mechanism must be correspondingly enhanced. When, however, the force of the opening and closing spring 21 increases, the force required to manually operate the opening and closing handle 11 also increases, thereby preventing a user from operating the circuit breaker easily. Thus, separately from the opening and closing spring 21, the supplementary spring 22 is additionally installed on the opening and closing lever 10, so that when the contact shoes are opened, the force from the supplementary spring 22 offsets the force from the contact spring 7 of the main circuit contact section. This correspondingly reduces the force of the opening and closing spring 21 and the force required to operate the opening and closing handle 11, thereby allowing the user to operate the circuit breaker easily.

Figure 3A:
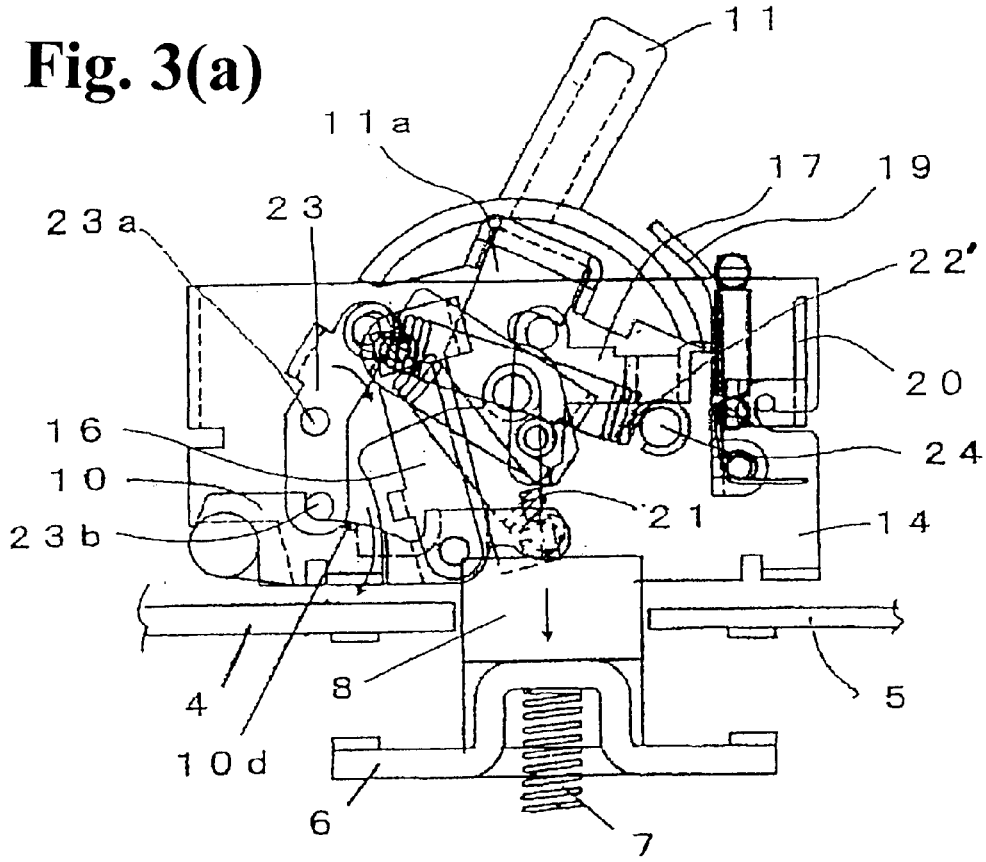
FIG. 3(*a*) is a side view showing a configuration of the contact opening and closing mechanism section in the open state corresponding to a second embodiment of the present invention.
Figure 3B:
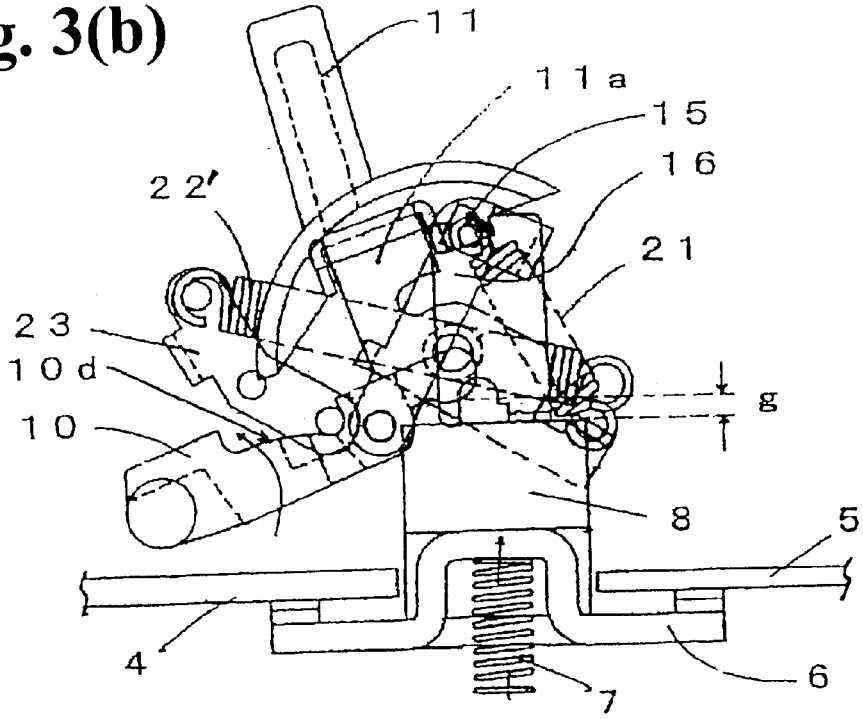

Next, a second embodiment of the present invention will be described with reference to FIGS. 3(*a*) and 3(*b*). In this example, in addition to the configuration shown in FIG. 1(*a*), a supplementary spring 22' extends as a tension spring between a supplementary lever 23 disposed above the opening and closing lever 10 to push it in and a support shaft 24 fixed to the assembly frame 14. In this case, the supplementary spring 22' is journaled to the frame 14 via a support shaft 23*a* and arranged so as to press and move a pin 23*b*, attached to a tip of the supplementary lever 23, on a cam surface 10*d* formed at a top surface of the opening and closing lever 10 in a manner extending from its root to tip.

With such a configuration, a tensile force from the supplementary spring 22' is applied to the cam surface 10*d* via the tip pin 23*b* of the supplementary lever 23 to push the opening and closing lever 10 downward. Additionally, the tip pin 23*b* of the supplementary lever 23 slides on the cam surface 10*d* in accordance with an inclined position of the opening and closing lever 10 corresponding to the open state of the contact shoes shown in FIG. 3(*a*) or the closed state thereof shown in FIG. 3(*b*).

In this case, the force of the supplementary spring 22' acting in a direction for inclining the opening and closing lever 10 downward is determined by a leverage ratio of the supplementary lever 23, an extended state thereof, and a point where the cam surface 10*d* and the pin 23*b* of the supplementary lever 23 come to abut against each other. Then, if the circuit breaker is set so that when the contact shoes are open as shown in FIG. 3(*a*), the force of the supplementary spring 22' pushing the opening and closing lever 10 downward substantially offsets the force of the contact spring 7 pushing the holder 8 of the movable contact shoe 6 upward, then during the circuit opening operation, the movable contact shoe 6 is reliably separated from the fixed contact shoes 4 and 5 due to the accumulated force of the opening and closing spring 21 acting on the opening and closing lever 10 via the toggle link, without the need to reinforce the opening and closing spring 21 as the main spring integrated into the contact opening and closing mechanism. This enables the opening and closing handle 11 to be easily operated without necessity of a strong force, thus allowing the user to operate the circuit breaker easily.

As described above, according to the first aspect of the present invention, the circuit breaker comprises the main circuit contact shoes disposed in the case at the bottom thereof and urged by the contact spring, the contact opening and closing mechanism located above the contact shoes and including the combination of the opening and closing lever, the toggle link, the opening and closing handle and the latch, and the overcurrent tripping device also located above the contact shoes. The toggle link comprises the first link having its lower end coupled to the opening and closing lever to extend to the toggle shaft located above and the second link extending between the toggle shaft and the latch in such a manner as to overlap the first link in the form of "V". The opening and closing spring extends between the toggle shaft and the tip of the handle lever coupled to the opening and closing handle to extend downward. As a result, the space occupied by the contact opening and closing mechanism section in the height direction can be reduced to make the circuit breaker more compact.

Additionally, the configuration in the second aspect makes the opening operation of the circuit breaker more reliable, and the configurations in the third and fourth aspects enable the main circuit contact shoes to be reliably opened because of the additional urging by the supplementary spring, thereby enabling the user to operate the opening and closing handle and thus the circuit breaker easily without the need to reinforce the opening and closing spring as the main spring. Therefore, a small and reliable circuit breaker is provided.

While the present invention has been explained with reference to the specific embodiments of the invention, the explanation is illustrative and the invention is limited only by the appended claims.

What is claimed is:

1. A circuit breaker comprising:

a main circuit contact section having at least one fixed contact shoe, a movable contact shoe situated near the at least one fixed contact shoe, a contact shoe holder for holding the movable contact shoe, and a contact spring for urging the movable contact shoe toward the at least one fixed contact shoe;

an opening and closing lever located above the main circuit contact section and having a journaled rear end and a tip located at a portion facing a top surface of the contact shoe holder; and a contact opening and closing mechanism located above the main circuit contact section and having a toggle link linking with the opening and closing lever, an opening and closing handle with a handle lever, an opening and closing spring extending between the handle lever and the toggle link, and a latch linking with the toggle link, wherein said toggle link includes a toggle shaft, a first link having a lower end coupled to the opening and closing lever and an upper end connected to the toggle shaft, and a second link extending between the toggle shaft and the latch as to overlap the first link in a V-form, said opening and closing spring extending between the toggle shaft and a tip of the handle lever coupled to the opening and closing handle to extend downward.

2. A circuit breaker according to claim 1, wherein said opening and closing lever is arranged such that when the opening and closing handle is moved to an ON side to close the main circuit contact, a gap is formed between the top, surface of the contact shoe holder and the tip of the opening and closing lever.

3. A circuit breaker according to claim 1, further comprising a supplementary spring for urging the opening and closing lever toward the contact shoe holder when the main circuit contact is opened, to thereby help urging the opening and closing spring.

4. A circuit breaker according to claim 3, wherein said supplementary spring has one end coupled to a supplementary push-in lever that slides over a cam surface formed at a top surface of the opening and closing lever to drive the supplementary lever to apply a push-in force to the opening and closing lever when the main circuit contact is opened.

5. A circuit breaker according to claim 3, wherein said supplementary spring is disposed on the opening and closing lever.

6. A circuit breaker according to claim 1, wherein said main circuit contact section is disposed in a lower case, and an overcurrent tripping device is located above the main circuit contact section to detect an overcurrent through a main circuit to release the latch.

7. A circuit breaker according to claim 1, further comprising a supplementary lever disposed above the opening and closing lever, a support shaft fixed to an assembly frame, and a supplementary spring between the supplementary lever and the support shaft.

* * * * *